US009612550B1

(12) United States Patent
Huang

(10) Patent No.: US 9,612,550 B1
(45) Date of Patent: Apr. 4, 2017

(54) TONER CARTRIDGE AND SIDE COVER THEREOF

(71) Applicant: GENERAL PLASTIC INDUSTRIAL CO., LTD., Taichung (TW)

(72) Inventor: Shih-Hsiung Huang, Taichung (TW)

(73) Assignee: General Plastic Industrial Co., Ltd., Taichung (TW)

( * ) Notice: Subject to any disclaimer, the term of this patent is extended or adjusted under 35 U.S.C. 154(b) by 0 days.

(21) Appl. No.: 14/972,861

(22) Filed: Dec. 17, 2015

(30) Foreign Application Priority Data

Sep. 10, 2015 (CN) ..... 2015 2 0698675 U

(51) Int. Cl.
*G03G 15/00* (2006.01)
*G03G 15/08* (2006.01)
*G03G 21/16* (2006.01)

(52) U.S. Cl.
CPC ..... *G03G 15/0865* (2013.01); *G03G 21/1647* (2013.01)

(58) Field of Classification Search
CPC ..... G03G 15/0886
USPC ..... 399/111, 113
See application file for complete search history.

(56) References Cited

U.S. PATENT DOCUMENTS 5,734,953 A * 3/1998 Tatsumi ..... G03G 15/0855 399/119
2003/0152401 A1* 8/2003 Cornelius ..... G03G 15/2035 399/124
2006/0133850 A1* 6/2006 Nishimura ..... G03G 15/0813 399/113
2009/0016779 A1* 1/2009 Hwang ..... G03G 15/0855 399/258
2011/0026967 A1* 2/2011 Kim ..... G03G 21/181 399/111
2012/0070185 A1* 3/2012 Yokota ..... G03G 21/1832 399/110
2013/0259532 A1* 10/2013 Kubota ..... G03G 21/1676 399/254

* cited by examiner

*Primary Examiner* — Quana M Grainger
(74) *Attorney, Agent, or Firm* — Muncy, Geissler, Olds & Lowe, P.C.

(57) ABSTRACT

The present invention provides a toner cartridge and a side cover thereof. The toner cartridge has a side opening, where the side cover is disposed, and a transmission device passing through the side opening. The toner cartridge is disposed in an electronic imaging device which is provided therein with a sliding rail, a moving piece, and an elastic member disposed between the sliding rail and the moving piece. The toner cartridge is installed into or unloaded from the electronic imaging device by sliding along the sliding rail. The side cover has a pushing portion located above the sliding rail for pushing the moving piece to move toward the elastic member in the process that the toner cartridge is unloaded from the electronic imaging device, so as to prevent the transmission device from being damaged by the moving piece, thereby extending the life time of the transmission device.

10 Claims, 10 Drawing Sheets

TONER CARTRIDGE AND SIDE COVER THEREOF

BACKGROUND OF THE INVENTION

1. Field of the Invention The present invention relates to toner cartridges and more particularly, to a toner cartridge disposed in an electronic imaging device, and a side cover of the toner cartridge.

2. Description of the Related Art

A conventional toner cartridge disposed in an electronic imaging device, such as a printer or a copy machine, is illustrated in FIGS. 1-4. The electronic imaging device 1 has a sliding rail 11, and an elastic moving piece 111 disposed on the sliding rail 11. The toner cartridge 2 is installed into the electronic imaging device 1 or unloaded from the electronic imaging device 1 by sliding along the sliding rail 11. The toner cartridge 2 is usually configured as shown in FIG. 2, having an opening 21 and a side cover 22 disposed at the opening 21 and passed through by a transmission device 3. An end of the transmission device 3 is mounted to a photosensitive cylinder (not shown). The side cover 22 has a main body, and an upper stopping portion 221 extended from the main body and located above the transmission device 3.

While the toner cartridge 2 is installed into the electronic imaging device 1 by sliding along the sliding rail 11, a part of the transmission device 3 is abutted on the sliding rail 11 and slides along the sliding rail 11. When arriving at the elastic moving piece 111, the transmission device 3 is pushed upwardly by the elastic moving piece 111, so that an end of the transmission device 3 is a little swung upwardly and stopped by the upper stopping portion 221. The aforesaid swinging motion enables the transmission device 3 to be coupled with a driving member 13 disposed inside the electronic imaging device 1. The transmission device 3 can transmit rotary kinetic energy from the driving member 13 to the photosensitive cylinder, and the photosensitive cylinder can conduct electricity when photosensitized and attract carbon powders at the same time to develop the to-be-printed document.

However, as shown in FIG. 3, while the toner cartridge 2 is unloaded from the electronic imaging device 1 by sliding along the sliding rail 11, the transmission device 3 is abutted against a corner 112 of the elastic moving piece 111 before pushing the elastic moving piece 111 downwardly and then continuing to slide. Therefore, after a period of usage of the toner cartridge, some part of the transmission device 3, such as an elastic member disposed on a shaft, is liable to be damaged by the corner 112; such situation is not adoptable for the dealers in this industry.

SUMMARY OF THE INVENTION

The present invention has been accomplished in view of the above-noted circumstances. It is an objective of the present invention to provide a side cover of a toner cartridge, which can prevent the transmission device from damage due to being abutted against the moving piece, so as to extend the life time of the transmission device.

To attain the above objective, the present invention provides a side cover of a toner cartridge. The toner cartridge has a side opening and a transmission device passing through the side opening. The toner cartridge is disposed in an electronic imaging device which is provided therein with a sliding rail, a moving piece, and an elastic member disposed between the sliding rail and the moving piece for providing a force to push the moving piece. The toner cartridge is installed into the electronic imaging device by sliding along the sliding rail and capable of being unloaded from the electronic imaging device by sliding along the sliding rail. The side cover of the toner cartridge comprises a cover body for being disposed at the side opening, a passage located at the cover body for the transmission device to pass through the passage, and a pushing portion attached to the cover body and located at an outer side of the passage for being located above the sliding rail and pushing the moving piece to move toward the elastic member in a process that the toner cartridge is unloaded from the electronic imaging device.

The present invention also provides a toner cartridge for being disposed in an electronic imaging device which is provided therein with a sliding rail, a moving piece, and an elastic member disposed between the sliding rail and the moving piece for providing a force to push the moving piece. The toner cartridge is installed into the electronic imaging device by sliding along the sliding rail and capable of being unloaded from the electronic imaging device by sliding along the sliding rail. The toner cartridge comprises a housing having a side opening, a transmission device passing through the side opening, and a side cover having a cover body disposed at the side opening, a passage located at the cover body and passed through by the transmission device, and a pushing portion attached to the cover body and located at an outer side of the passage for being located above the sliding rail and pushing the moving piece to move toward the elastic member in a process that the toner cartridge is unloaded from the electronic imaging device.

As a result, the transmission device is prevented from damage due to being abutted against the moving piece because the moving piece is pushed to move downwardly by the pushing portion, so that the present invention is effective in extending the life time of the transmission device.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
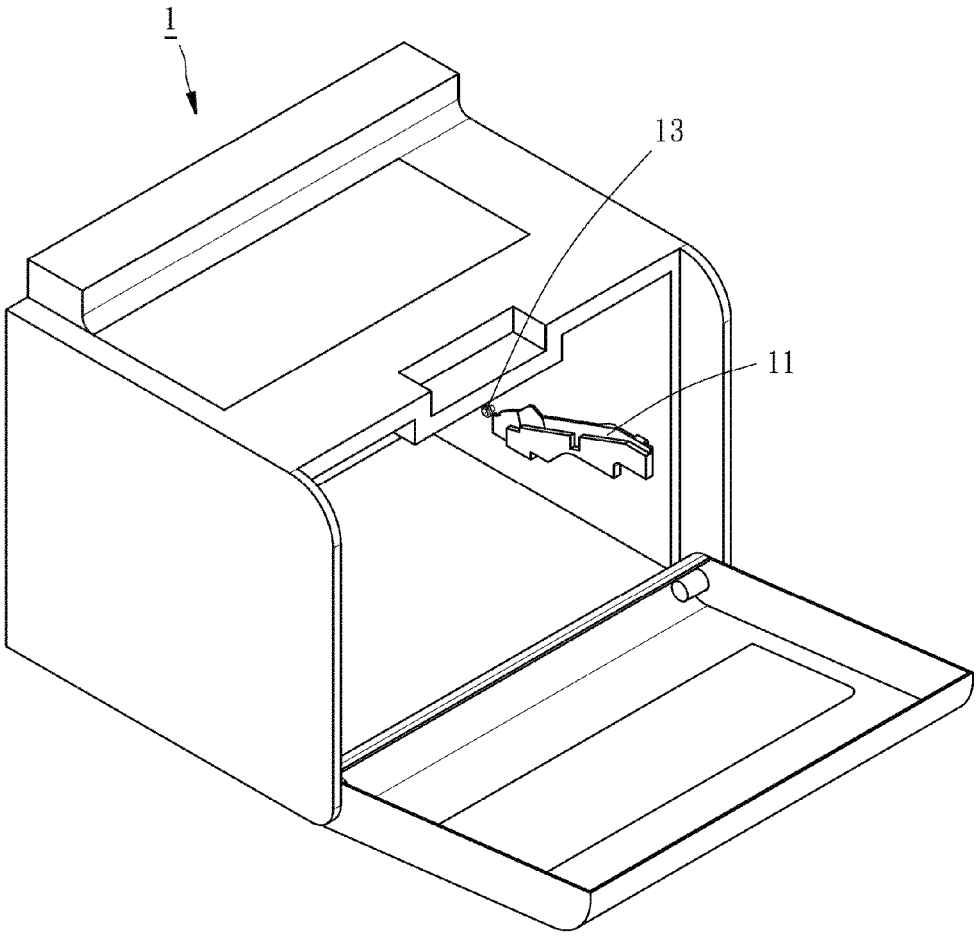
FIG. 1 PRIOR ART
FIG. 1 is a perspective view of a conventional electronic imaging device.
Figure 2:
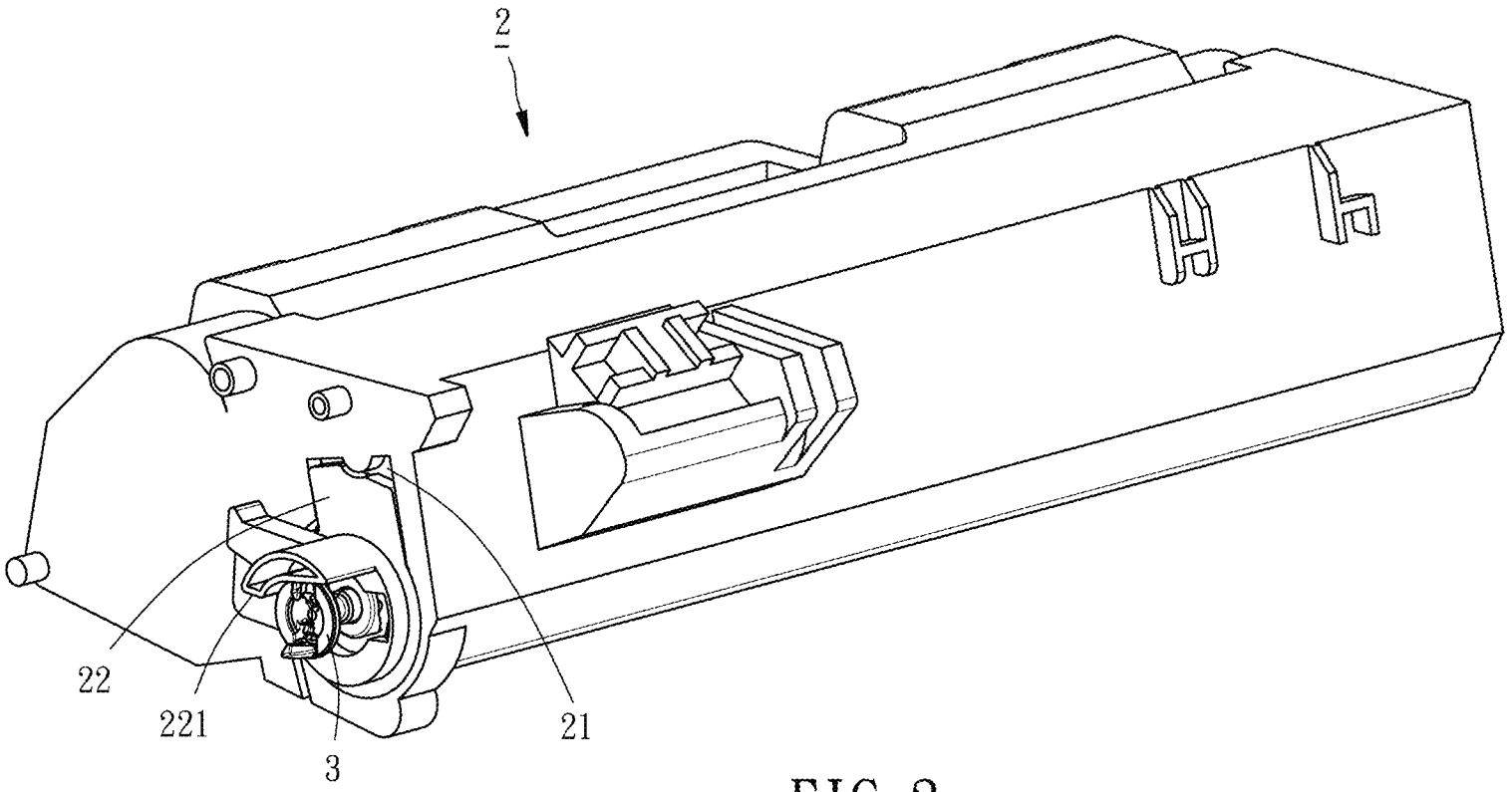
FIG. 2 PRIOR ART
FIG. 2 is a perspective view of a conventional toner cartridge.
Figure 3:
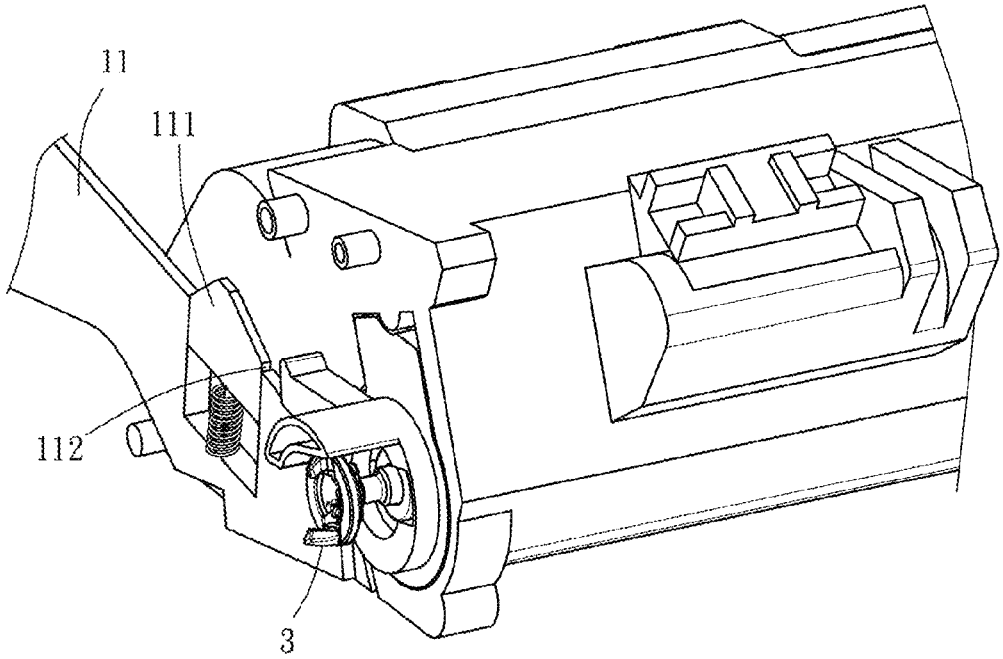
FIG. 3 PRIOR ART
FIG. 3 is a perspective view of a part of the conventional electronic imaging device and a part of the conventional toner cartridge disposed in the electronic imaging device.
Figure 4:
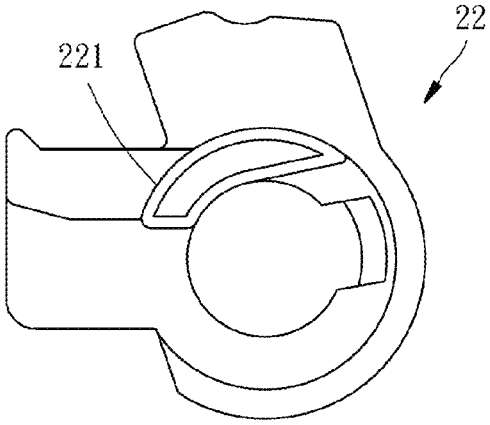
FIG. 4 PRIOR ART
FIG. 4 is a lateral view of a side cover of the conventional toner cartridge.
Figure 5:
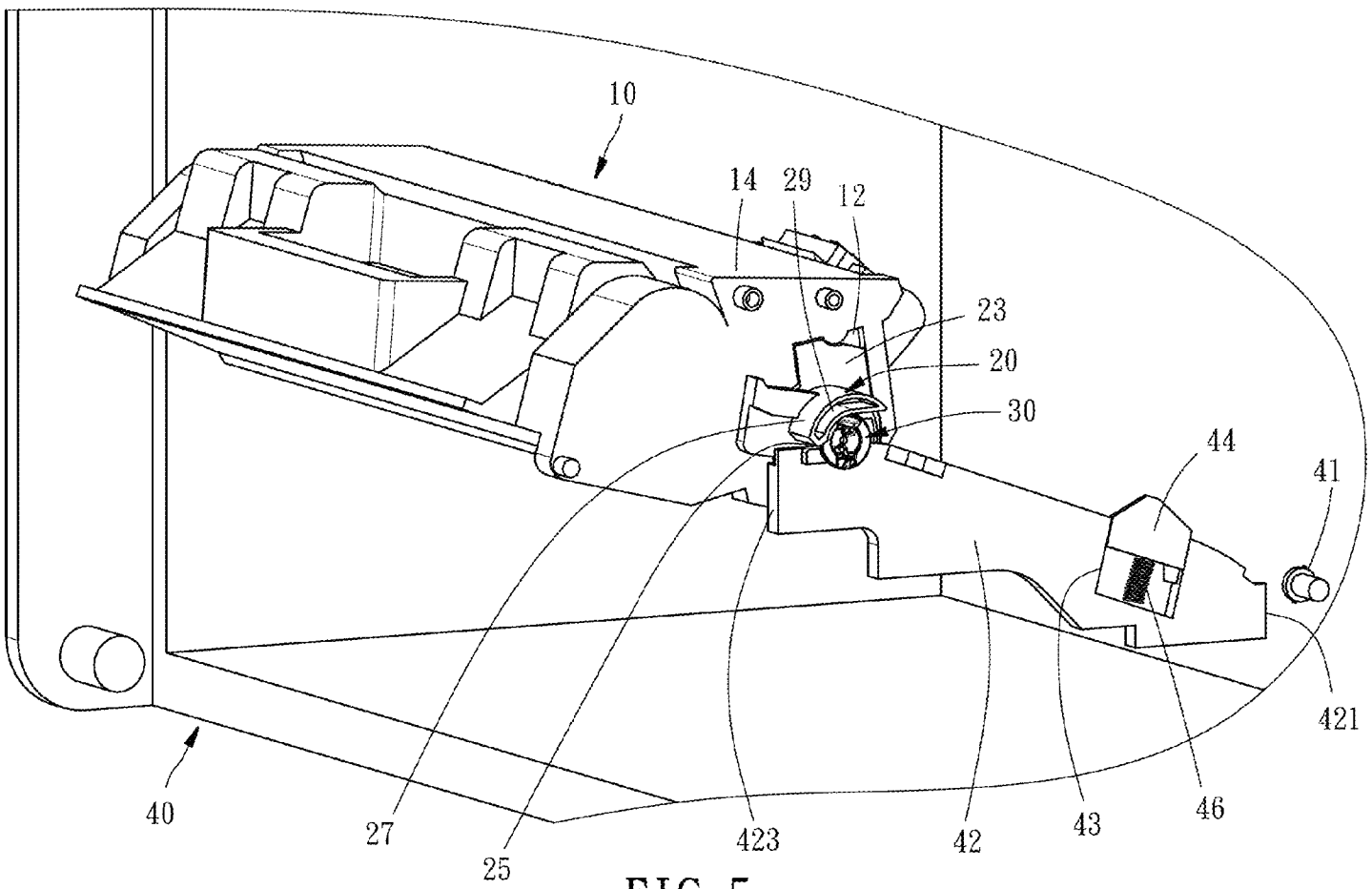
FIG. 5 is a perspective view of a part of an electronic imaging device and a toner cartridge disposed in the electronic imaging device according to a first preferred embodiment of the present invention.
Figure 6:
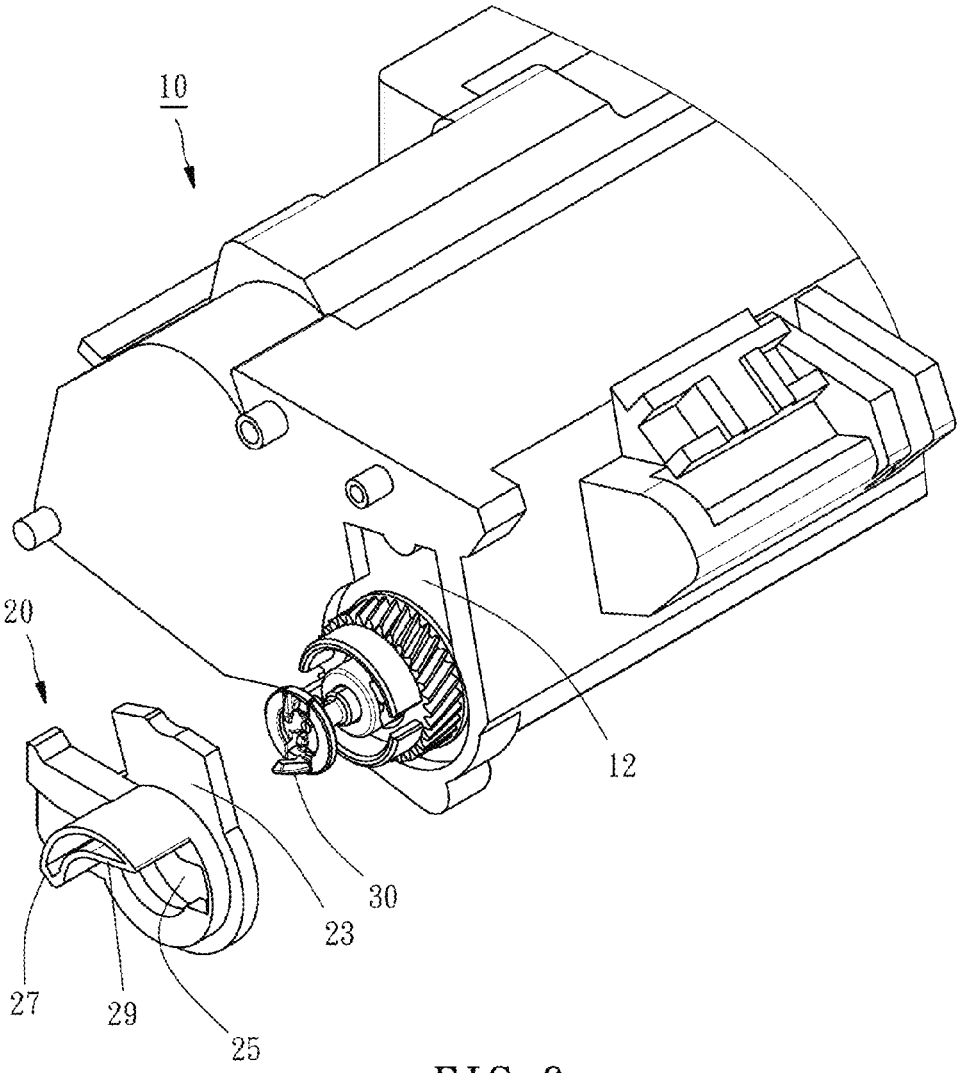
FIG. 6 is an exploded perspective view of a part of the toner cartridge according to the first preferred embodiment of the present invention.

A toner cartridge 10 according to a first preferred embodiment of the present invention is illustrated in FIGS. 5-10. Referring to FIGS. 5-6, the toner cartridge 10 is disposed in an electronic imaging device 40. The toner cartridge 10 has a housing 14, a transmission device 30 and a side cover 20. The housing 14 has a side opening 12. An end of the transmission device 30 passes through the side opening 12 and is connected with a driving member 41 of the electronic imaging device 40. The other end of the transmission device 30 is connected with a photosensitive cylinder (not shown) disposed in the housing 14, so that the rotary kinetic energy can be transmitted from the driving member 41 to the photosensitive cylinder through the transmission device 3. The photosensitive cylinder can conduct electricity when photosensitized and attract carbon powders at the same time to develop the to-be-printed document. The electronic imaging device 40 is provided at the inner wall thereof with a sliding rail 42, a moving piece 44 disposed in a concave 43 of the sliding rail 42, and an elastic member 46 disposed between the sliding rail 42 and the moving piece 44 and located in the concave 43. The elastic member 46 provides a force to push the moving piece 44 upwardly. The toner cartridge 10 can be installed into or unloaded from the electronic imaging device by sliding along the sliding rail 42. The sliding rail 42 has an inner end 421 and an outer end 423. The moving piece 44 is located close to the inner end 421 and away from the outer end 423. The present invention defines the motion of the toner cartridge 10 sliding along the sliding rail 42 in a way that the toner cartridge 10 slides inwardly means it slides toward the inner end 421 and the toner cartridge 10 slides outwardly means it slides toward the outer end 423. In this embodiment, the sliding rail 42 is shaped as a plate for the toner cartridge 10 to slide along an upper edge of the plate, but it is not limited thereto. In other embodiments, the sliding rail 11 can be modified.

Figure 7:
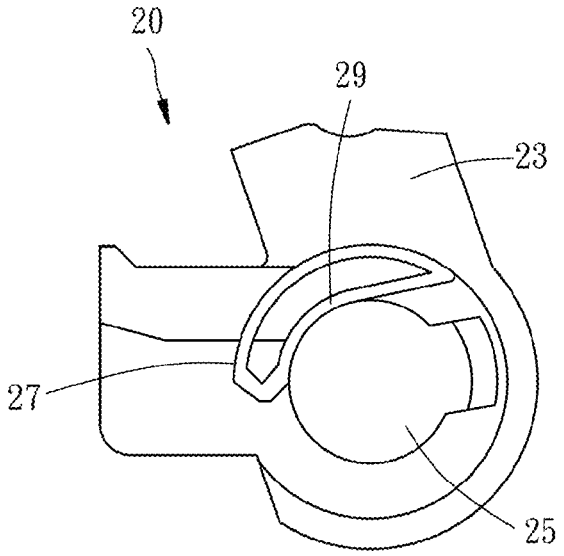
FIG. 7 is a lateral view of a side cover of the toner cartridge according to the first preferred embodiment of the present invention.
Figure 8:
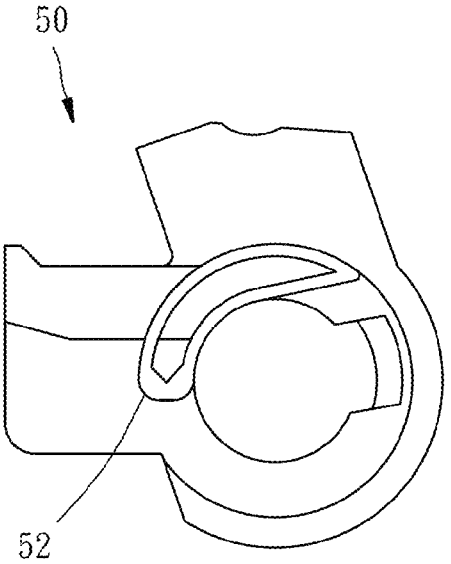
FIG. 8 is a lateral view of a side cover of a toner cartridge according to a second preferred embodiment of the present invention.

As shown in FIG. 7, the side cover 20 of the toner cartridge 10 includes a cover body 23, a passage 25 located at the cover body 23, a pushing portion 27, and an upper stopping portion 29. The cover body 23 is disposed at the side opening 12 of the toner cartridge 10 for covering the most of the side opening 12 or the whole side opening 12. The transmission device 30 passes through the passage 25. The pushing portion 27 is integrally extended from the cover body 23 and located at an outer side of the passage 25. The outer side mentioned in the present invention means the side of the passage 25, which is closer to the outer end 423 of the sliding rail 42 than the other sides of the passage 25. The pushing portion 27 is located above the sliding rail 42, and the upper stopping portion 29 is extended from the cover body 23, located at a top side of the passage 25, and connected with the pushing portion 27 integrally. In other embodiments, the pushing portion 27 and the upper stopping portion 29 may be provided apart from each other or configured as individual elements. In this embodiment, the pushing portion 27 has a V-shaped outer edge located at the outer side of the passage 25. The shape of the pushing portion 27 is not limited to that illustrated in this embodiment, but can be modified in other embodiments. For example, in the toner cartridge according to a second preferred embodiment of the present invention as shown in FIG. 8, the outer edge of the pushing portion 52 of the side cover 50 is rounded-U-shaped.

Figure 9:
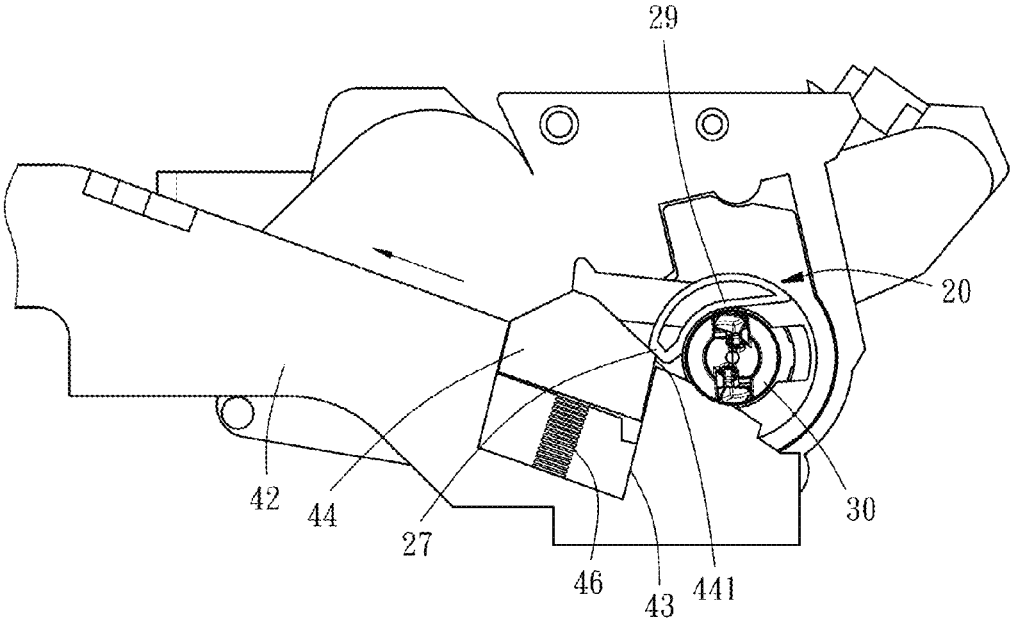
FIGS. 9-11 are schematic views illustrating the process that the toner cartridge is unloaded from the electronic imaging device according to the first preferred embodiment of the present invention.
Figure 10:
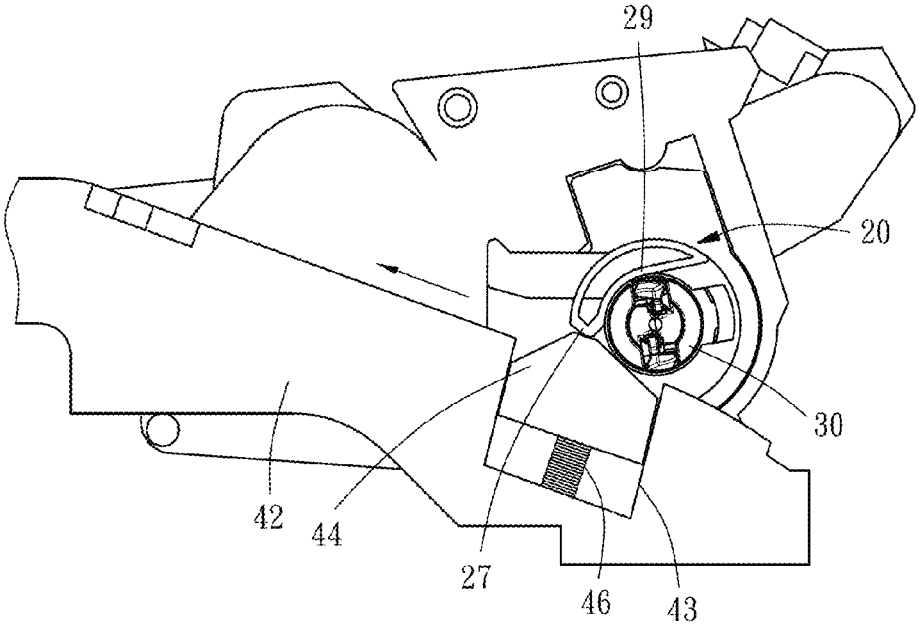
Figure 11:
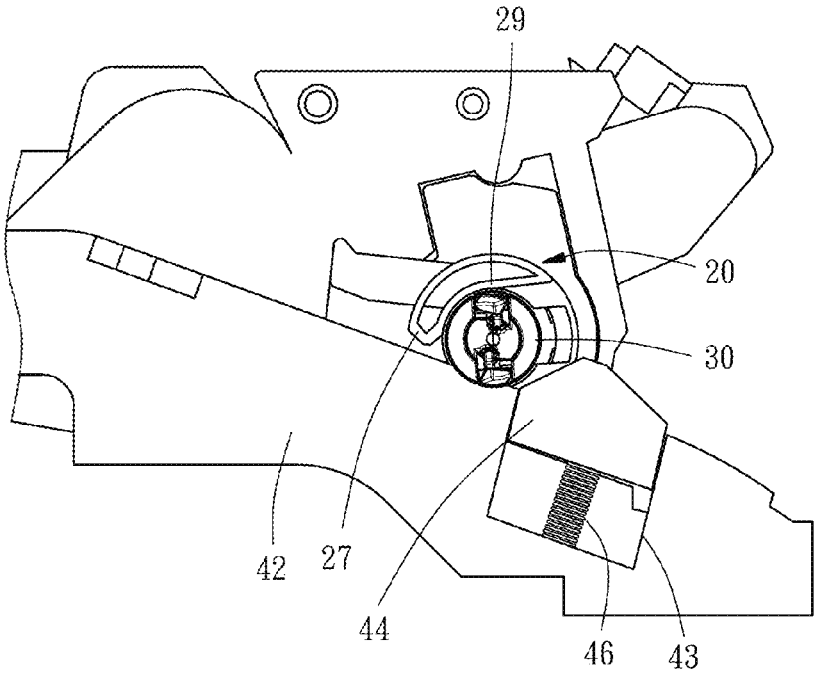

In the process that the toner cartridge 10 is installed into the electronic imaging device 40 as shown in FIG. 5, the transmission device 30 is abutted on the sliding rail 42 and slides inwardly along the sliding rail 42. When arriving at the moving piece 44, the transmission device 30 pushes the moving piece 44 downwardly. At this time, the moving piece 44 has a reacting force to push the transmission device 30 upwardly to make the transmission device 30 swing upwardly and stopped by the upper stopping portion 29, so that the transmission device 30 can swing to the predetermined position for being connected with the driving member 41. Referring to FIGS. 9-11, in the process that the toner cartridge 10 is unloaded from the electronic imaging device 40, at first the outer edge of the pushing portion 27 pushes the moving piece 44 to move downwardly; at this time, the V-shaped configuration prevents the pushing portion 27 from head-on collision with the corner 441 of the moving piece, as shown in FIG. 9. After that, the transmission device 30 slides over the upper edge of the moving piece 44, as shown in FIG. 10. When the toner cartridge 10 further slides outwardly and no longer pushes the moving piece 44, the elastic member 46 provides the moving piece 44 an upward force to make the moving piece 44 move back to the initial position, as shown in FIG. 11.

Therefore, in the process that the toner cartridge 10 is unloaded from the electronic imaging device by sliding outwardly, the corner 441 of the moving piece 44, which is initially protruded out of the upper edge of the sliding rail 42, is hided in the concave 43 of the sliding rail 42 when the pushing portion 27 pushes the moving piece 44 downwardly toward the elastic member 46, so that the transmission device 30 is unlike that of the conventional toner cartridge to be prevented from damage due to being abutted against a specific portion of the corner 441 for a long time. So the present invention is effective in extending the life time of the transmission device 30.

Figure 12:
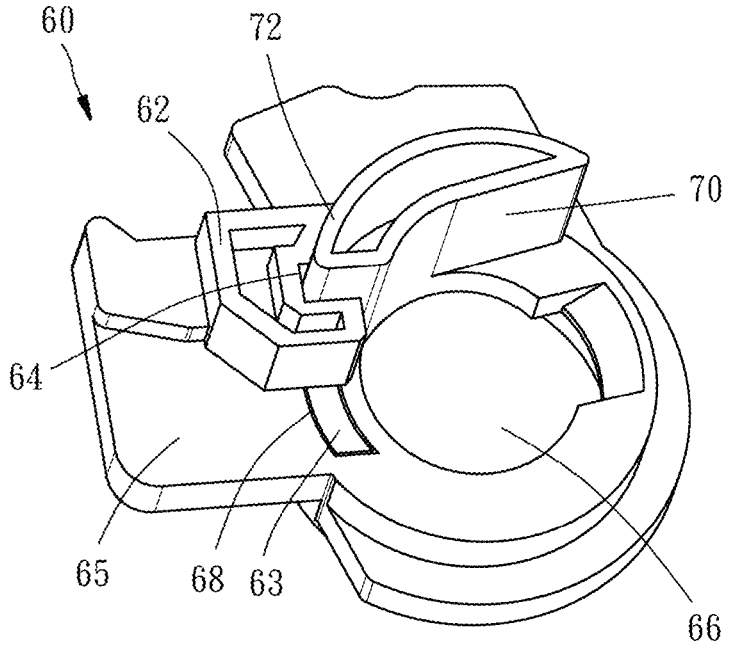
FIG. 12 is an assembled perspective view of a side cover of a toner cartridge according to a third preferred embodiment of the present invention.
Figure 13:
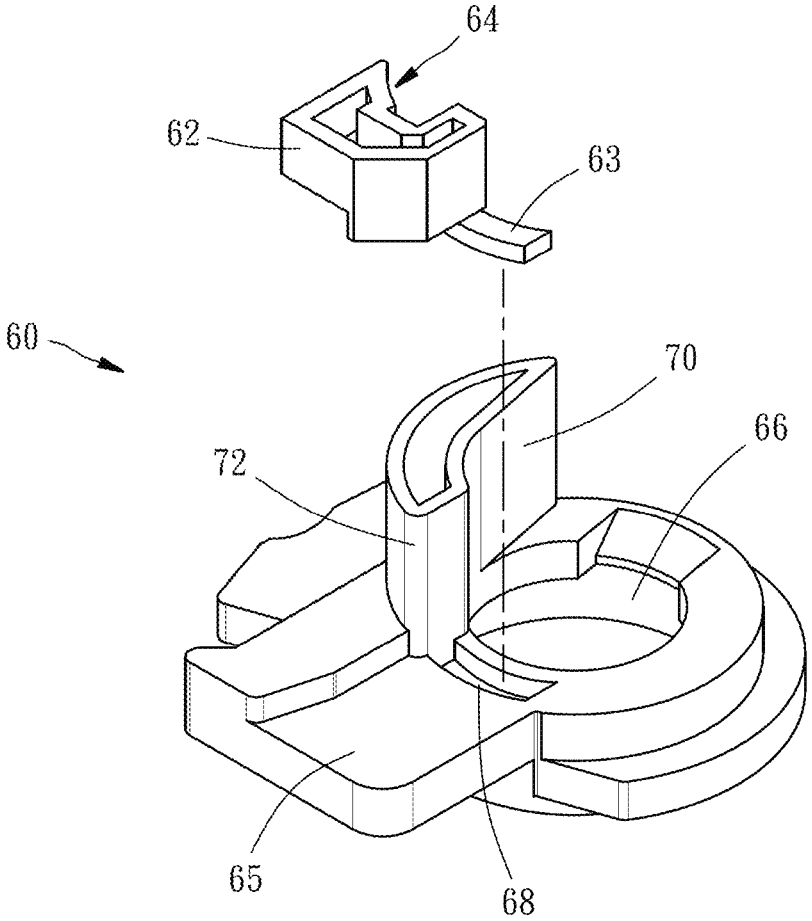
FIG. 13 is an exploded perspective view of the side cover of the toner cartridge according to the third preferred embodiment of the present invention.

Based on the spirit of the present invention, the configuration of the side cover of the toner cartridge can be modified according to usage requirements. The pushing portion can be an individual element independent of the cover body, such as that of the toner cartridge according to a third preferred embodiment of the present invention as shown in FIGS. 12-13. In the third preferred embodiment, the pushing portion 62 of the side cover 60 is an individual element having an embedded rib 63 and a recess 64. The cover body 65 of the side cover 60 has an arc-shaped groove 68 located at the outer side of the passage 66, and an upper stopping portion 70 is provided at the top side of the passage 66. In the process of assembling the side cover, the pushing portion 62 approaches the cover body 65 in the direction parallel to the axial of the passage 66 to make the embedded rib 63 embedded in the groove 68 and make the outer edge 72 of the upper stopping portion 70 located in the recess 64 of the pushing portion 62 at the same time, so that the pushing portion 62 and the cover body 65 are combined together firmly. In this way, the user may need to buy only one individual element, i.e. the pushing portion 62, and install the pushing portion 62 on the side cover of the conventional toner cartridge, to achieve the effect of extending the life time of the transmission device. The pushing portion 62 may have no such embedded rib 63 and recess 64, and combined with the cover body 65 in some other ways. For example, the pushing portion 62 can be combined with the cover body 65 by glue.

The above description represents merely the preferred embodiments of the present invention, without any intention to limit the scope of the present invention. The simple variations and modifications not to be regarded as a departure from the spirit of the invention are intended to be included within the scope of the following claims.

What is claimed is:

1. A side cover of a toner cartridge, the toner cartridge having a side opening and a transmission device passing through the side opening, the toner cartridge being disposed in an electronic imaging device which is provided therein with a sliding rail, a moving piece, and an elastic member disposed between the sliding rail and the moving piece for providing a force to push the moving piece, the toner cartridge being installed into the electronic imaging device by sliding along the sliding rail and capable of being unloaded from the electronic imaging device by sliding along the sliding rail, the side cover of the toner cartridge comprising:

a cover body for being disposed at the side opening;

a passage located at the cover body for the transmission device to pass through the passage; and a pushing portion attached to the cover body and located at an outer side of the passage for being located above the sliding rail and pushing the moving piece to move toward the elastic member in a process that the toner cartridge is unloaded from the electronic imaging device.

2. The side cover of the toner cartridge as claimed in claim 1, wherein the pushing portion is extended from the cover body integrally.

3. The side cover of the toner cartridge as claimed in claim 2, further comprising an upper stopping portion attached to the cover body, located at a top side of the passage, and connected with the pushing portion integrally.

4. The side cover of the toner cartridge as claimed in claim 1, wherein the cover body has a groove; the pushing portion is an individual element having an embedded rib embedded in the groove.

5. The side cover of the toner cartridge as claimed in claim 4, wherein the pushing portion has a recess; the side cover further comprising an upper stopping portion attached to the cover body, located at a top side of the passage, and having an outer edge located in the recess.

6. A toner cartridge for being disposed in an electronic imaging device, the electronic imaging device being provided therein with a sliding rail a moving piece, and an elastic member disposed between the sliding rail and the moving piece for providing a force to push the moving piece, the toner cartridge being installed into the electronic imaging device by sliding along the sliding rail and capable of being unloaded from the electronic imaging device by sliding along the sliding rail, the toner cartridge comprising:

a housing having a side opening;

a transmission device passing through the side opening;

a side cover having a cover body disposed at the side opening, a passage located at the cover body and passed through by the transmission device, and a pushing portion attached to the cover body and located at an outer side of the passage for being located above the sliding rail and pushing the moving piece to move toward the elastic member in a process that the toner cartridge is unloaded from the electronic imaging device.

7. The toner cartridge as claimed in claim 6, wherein the pushing portion of the side cover is extended from the cover body integrally.

8. The toner cartridge as claimed in claim 7, wherein the side cover has an upper stopping portion attached to the cover body, located at a top side of the passage, and connected with the pushing portion integrally.

9. The toner cartridge as claimed in claim 6, wherein the cover body of the side cover has a groove; the pushing portion of the side cover is an individual element having an embedded rib embedded in the groove.

10. The toner cartridge as claimed in claim 9, wherein the pushing portion has a recess; the side cover has an upper stopping portion attached to the cover body, located at a top side of the passage, and having an outer edge located in the recess.

* * * * *